United States Patent [19]

Fertl et al.

[11] 4,399,359

[45] Aug. 16, 1983

[54] METHOD FOR MONITORING FLOOD FRONT MOVEMENT DURING WATER FLOODING OF SUBSURFACE FORMATIONS

[75] Inventors: Walter H. Fertl; Elton Frost; Donald W. Oliver, all of Houston, Tex.

[73] Assignee: Dresser Industries, Inc., Dallas, Tex.

[21] Appl. No.: 214,311

[22] Filed: Dec. 8, 1980

[51] Int. Cl.[3] ..... G10V 5/00

[52] U.S. Cl. ..... 250/270; 250/258; 250/269; 166/252

[58] Field of Search ..... 250/270, 258, 256, 269; 166/252

[56] References Cited

U.S. PATENT DOCUMENTS 4,020,342 4/1977 Smith, Jr. et al. ..... 250/270

4,136,279 1/1979 Hopkinson ..... 250/270

OTHER PUBLICATIONS

Youngblood, "The Application of Pulsed Neutron Decay Time Logs to Monitor Waterfloods with Changing Salinity," J. Petro. Tech., Jun. 1980, pp. 957–963.

*Primary Examiner*—Davis L. Willis

*Assistant Examiner*—Carolyn E. Fields

*Attorney, Agent, or Firm*—Richard M. Byron; Patrick H. McCollum

[57] ABSTRACT

A method is disclosed for monitoring the flood front movement during enhanced recovery operations wherein flooding fluids are pumped into a number of injection wells forcing residual oil movement toward a production well. A plurality of monitoring wells located between the injection wells and the producing well are logged to establish base logs functionally related to oil saturation and water salinity. Periodically during the water flood operation, the monitoring wells are relogged to detect changes in oil saturation and water salinity. By comparison of the base logs with the series of later derived logs it is possible to accurately monitor the flood front movement including detecting high-permeability zones and monitoring of the flood front profile.

9 Claims, 5 Drawing Figures

FIG. 2
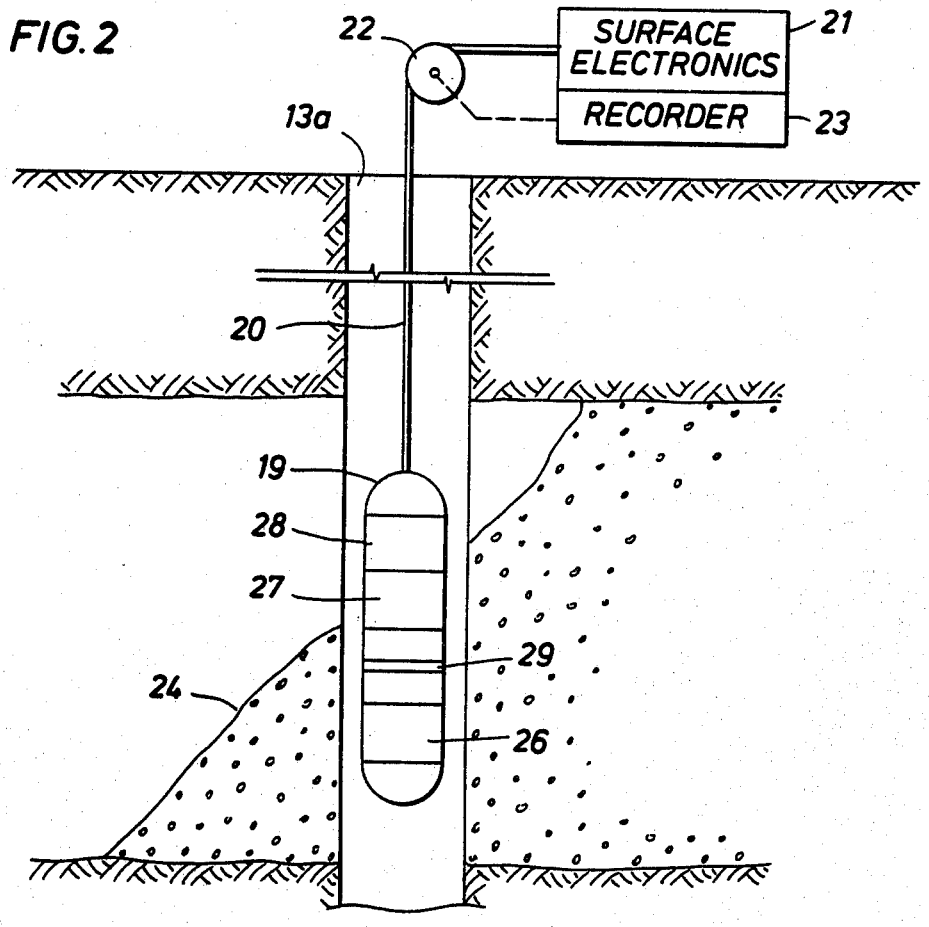
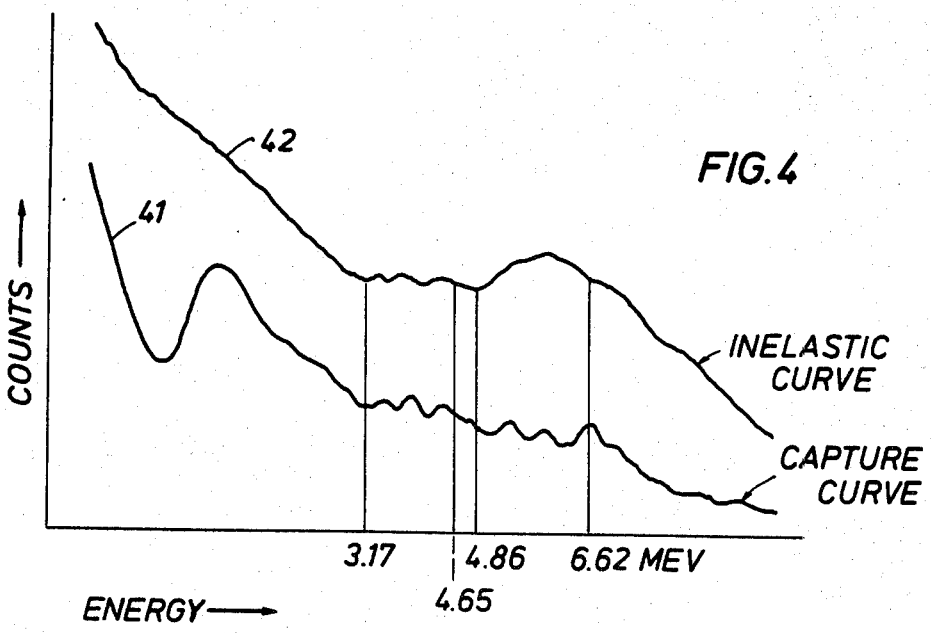
FIG. 4

METHOD FOR MONITORING FLOOD FRONT MOVEMENT DURING WATER FLOODING OF SUBSURFACE FORMATIONS

BACKGROUND OF THE INVENTION

This invention relates generally to methods for monitoring flood front movement during secondary and tertiary oil recovery and more specifically to methods for monitoring salinity and oil saturation changes and directional flood front movement of water injected into subsurface formations.

In the production of oil from subsurface locations it is well known that frequently primary production methods are ineffective in recovering substantially all the oil within a reservoir. The depletion of the reservoir energy before the depletion of the recoverable oil leaves a portion of the oil in the ground without a natural propulsive energy to move it. After the reservoir energy is about exhausted, and the production is approaching its economic limit, much of the remaining oil may be recovered by supplying a new energy source. One such outside source of energy utilized in secondary and tertiary recovery operations is the injection of water into the subsurface formations.

Water flooding depends on the ability of injected water to displace the oil remaining in the reservoir in the same manner it displaces oil in the primary production of a water-drive reservoir. Water is injected into the reservoir through a number of intake wells located at spaced intervals. As the injected water enters the reservoir, it moves toward the area of lower fluid potential and, as it moves, drives the oil left behind during the primary recovery phase. An increased oil saturation develops ahead of the moving water and finally reaches the production wells.

In performing a water flooding operation it is important to monitor the progress of the flood front to determine the lateral movement thereof. Due to formation characteristics, the flood front does not move in uniform fashion from the injection wells toward the production well. Further, subsurface formations may contain high-permeability streaks which allow injected water to break through the oil into the production well. The result of such a breakthrough is the production from the well of water while significant oil may remain in the formations.

In the prior art, various methods have been utilized to monitor the progress of the flood front in secondary and tertiary oil recovery operations. One such method as disclosed in U.S. Pat. No. 3,874,451, issued to Jones et al, detects the arrival of the flood front by monitoring the pressure change in boreholes. A requirement of Jones et al is that the boreholes used for pressure monitoring must be uncased. In a production reservoir this can require the removal of casing already present in the boreholes or the drilling of new, uncased boreholes.

U.S. Pat. No. 4,085,798, issued to Schweitzer et al discloses a method for monitoring the flood front profile during water flooding by adding a tracer element having a characteristic gamma ray emission energy to the flood fluid. The tracer element may be unlike any element nomrally found in the formation, or it may be an element similar to elements normally present in the formation. It is recognized as a serious disadvantage to be required to add tracer elements to the flood fluid prior to injection. Additionally, since the Schweitzer method is only directed to detecting elements in the injection fluid it does not provide an indication of flood front movement until the fluid flood front reaches or nearly reaches the monitor boreholes.

Accordingly, the present invention overcomes the deficiencies of the prior art by providing a method for monitoring the flood front movement through cased boreholes without alteration of the injection fluid.

SUMMARY OF THE INVENTION

A high energy neutron source is caused to traverse a borehole located between the injection wells and a production well. The source is periodically pulsed to thereby irradiate the formations with neutrons. A detector system detects radioactivity resulting from inelastic scattering and neutron capture. The detected signals are coupled to a surface electronics which processes the signals to derive a first measurement representative of oil saturation and a second measurement representative to formation water salinity. At intervals during the flooding operation the borehole is relogged to monitor changes in oil saturation and water salinity. By establishing a time-series of oil saturation and water salinity logs the progress of the flood front through the formation can be monitored.

Accordingly, it is a feature of the present invention to provide a method for monitoring the progress of a flood front through an oil production formation.

it is still another feature of the invention to provide a method for monitoring the flood front profile from cased boreholes.

It is yet another feature of the present invention to provide a method for detecting high-permeability zones in an oil producing formation.

It is still another feature of the present invention to provide a method of monitoring flood front progress by time-series monitoring of oil saturation and water salinity.

It is another feature of the present invention to provide a method of monitoring the formation fluid and injection fluid mixing factor to determine salinity changes related to injection fluid movement.

BRIEF DESCRIPTION OF THE DRAWINGS

FIG. 2 is a side elevation, partly in cross-section, of a well logging operation in accordance with the present invention;

FIG. 4 graphically illustrates a portion of a spectral curve plotting radiation counts versus energy levels of various gamma rays.

DETAILED DESCRIPTION OF THE DRAWINGS

Figure 1:
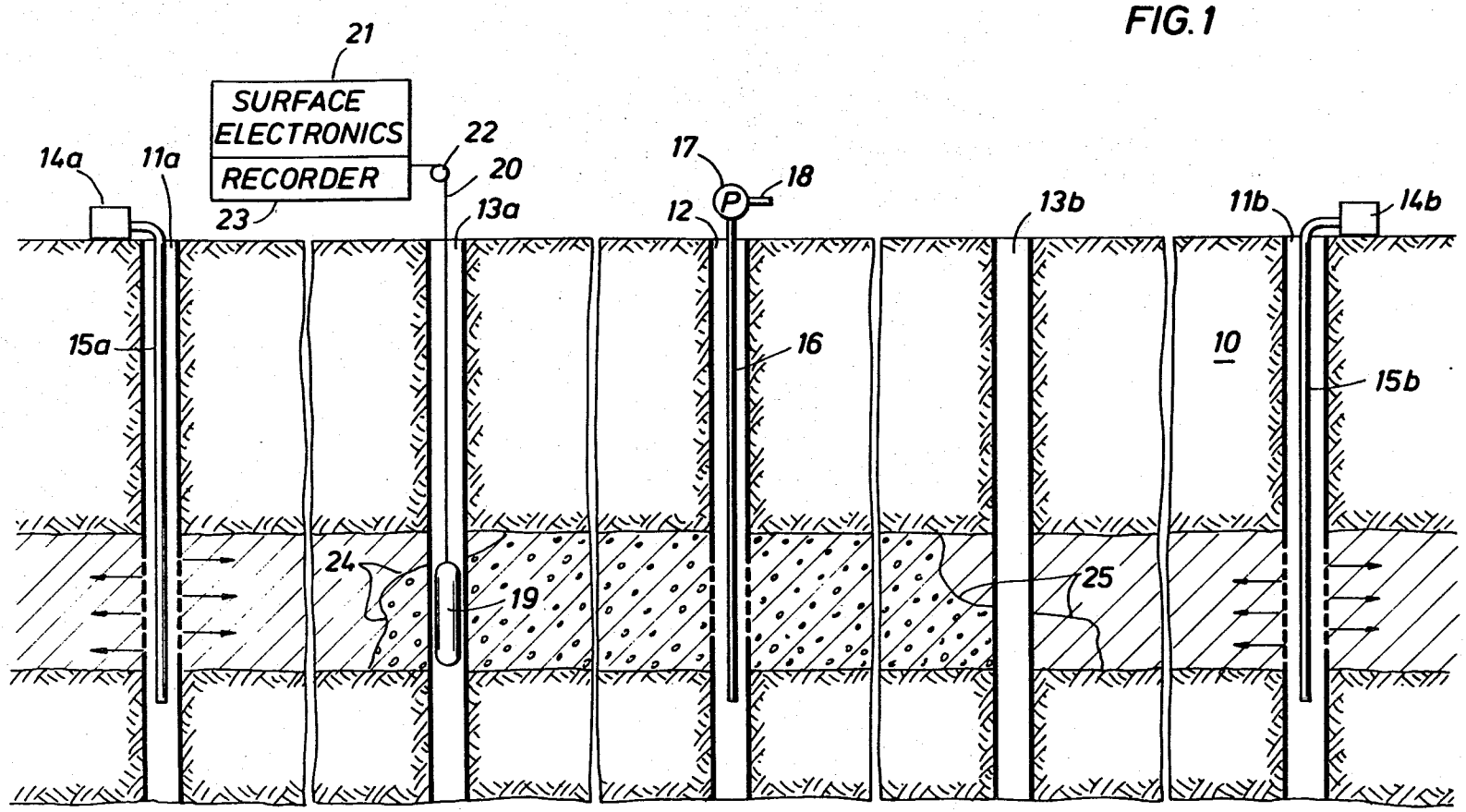
FIG. 1 is a section of earth formations illustrating the monitoring of a flood front in accordance with the present invention.

Referring now to the drawings in more detail, particularly to FIG. 1, there is illustrated a section of the earth formations 10 in which secondary or tertiary recovery is undertaken to enhance the amount of recoverable oil. The earth formations 10 are penetrated by a plurality of injection wells 11*a* and 11*b*, a production well 12 and a plurality of monitoring wells 13*a* and 13*b*, located between the injection wells 11*a* and 11*b* and the production well 12. It should be understood that the number of injection wells and monitoring wells illustrated is exemplary only, and that the actual number will differ in accordance with the size of the reservoir to undergo water flooding.

Injection wells, 11*a* and 11*b*, and production well 12 are cased with perforations at the level of the formations where primary production has occurred. Monitoring wells, 13*a* and 13*b*, are cased and may or may not be perforated. Located at the surface are injection pumps 14*a* and 14*b* to which are attached tubings 15*a* and 15*b*, respectively. Tubings 15*a* and 15*b* extend from surface pumps 14*a* and 14*b* into injection wells 11*a* and 11*b*, respectively. Production tubing 16 is disposed within production well 12, terminating at surface pump 17. Attached to pump 17 is pipe 18 which carries oil pumped from production well 12 to storage facilities (not shown).

In accordance with the present invention, suspended within monitoring well 13*a* is subsurface logging instrument 19. Cable 20 suspends instrument 19 within monitoring well 13*a* and contains the required conductors for electrically connecting the subsurface instrument 19 with the surface electronics 21. The cable is wound on or unwound from drum 22 in raising and lowering instrument 19 to traverse the well. Electrical signals transmitted to surface electronics 21 from instrument 19 are processed by circuitry within surface electronics 21 and recorded on recorder 23, as will be fully explained hereinafter.

In secondary or tertiary recovery operations, surface pumps 14*a* and 14*b* are supplied with water from the most convenient source available. The water source can be surface pools, area lakes, surrounding seas, or wells drilled into water bearing formations. The water source to be utilized is chosen as being the most ecologically safe and economically available source. It should be appreciated that the chemical characteristics of the injection water will vary greatly from one water source to another.

Pumps 14*a* and 14*b* pump water from the surface to within injection wells 11*a* and 11*b* through tubings 15*a* and 15*b*, respectively. The injection water is forced through the perforations located in the casing of injection wells 11*a* and 11*b* into the permeable formation which was the source of primary oil production. The flood front expands radially from injection wells 11*a* and 11*b* driving the residual oil in the producing formations toward producing well 12. The advancement of the flood front, shown generally at numerals 24 and 25, causes an area of increased oil saturation to develop ahead of the moving water. Additionally, as the injection water flood front advances there is a change in the salinity of the water as the injection water contaminates the water located within the production formations.

As previously mentioned, to monitor the progress of the flood fronts 24 and 25 through the permeable production zone logging instrument 19 is caused to traverse the cased monitoring well. Electrical signals are generated indicative of oil saturation and the change in water salinity of the subsurface formations. The logging instrument is run in each monitoring well located between the injection wells and the producing well in order to obtain a complete profile of the water flood front.

Referring now to FIG. 2, there is illustrated in greater detail the logging operation of FIG. 1. Injection well 13*a* penetrates the earth's surface. Disposed within injection well 13*a* is subsurface instrument 19 of the well logging system. Subsurface instrument 19 comprises a pulsed neutron source 26, a detecting system 27, a subsurface electronics package 28 and a neutron shield 29 located between the source 26 and the detector 27. As previously stated, cable 20 suspends instrument 19 within injection well 13*a* and contains the required conductors for electrically connecting instrument 19 with surface electronics 21.

In making a radioactivity log of the injection well 13*a*, instrument 19 is caused to traverse the well. Thereby high energy neutrons from source 26 irradiate the formations surrounding the borehole and radiations influenced by the formations are detected by the detecting system 27. The resultant signals are processed by subsurface electroncis 28 and are sent to the surface electronics 21 through cable 20, where the signals are further processed and recorded on recorder 23. Recorder 23 is driven in coordination with the movement of the subsurface instrument 19 within injection well 13*a*.

Figure 3:
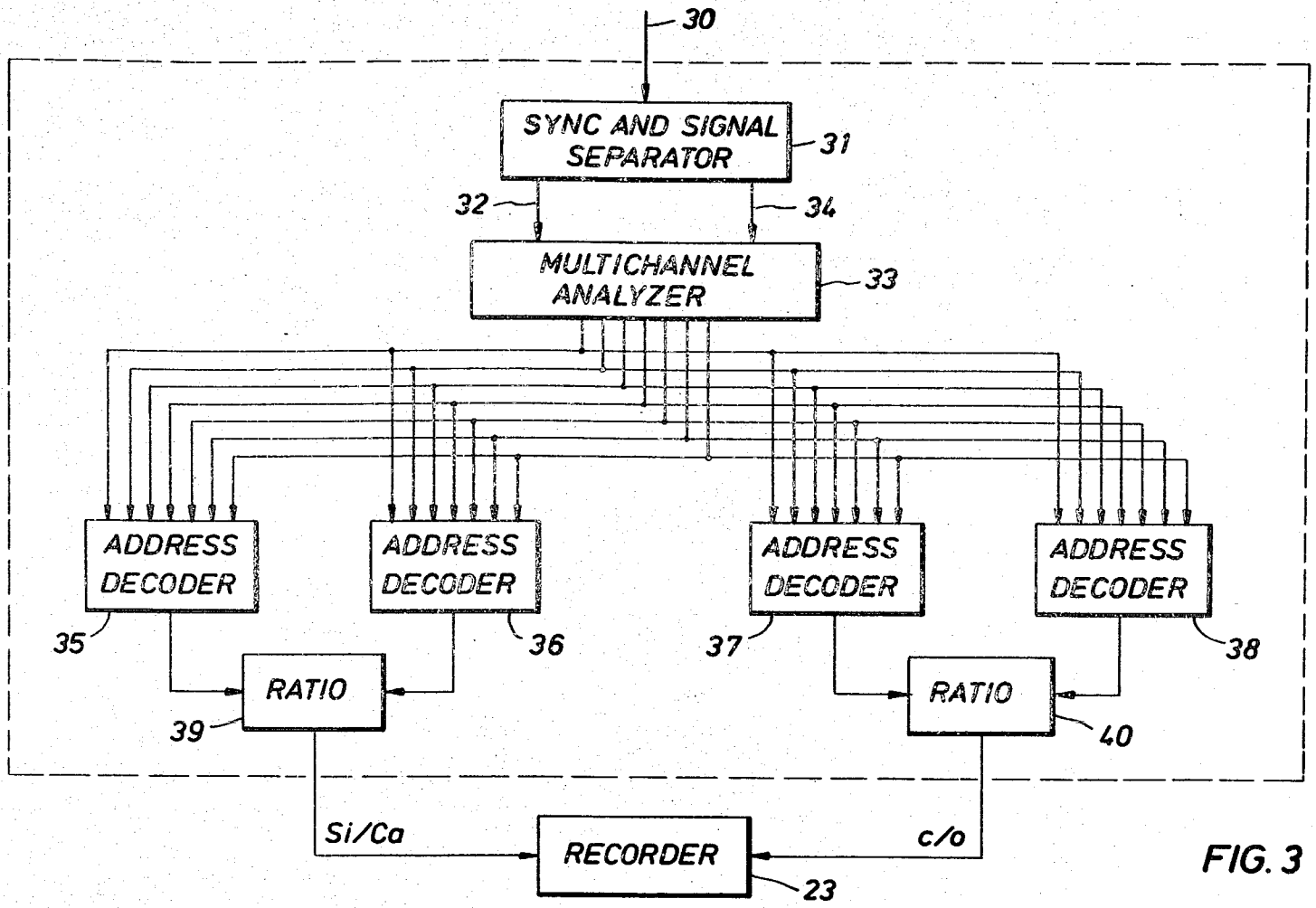
FIG. 3 is a block diagram of a portion of the surface circuitry according to the present invention.

Referring now to FIG. 3, a portion of surface electronics 21 is shown in greater detail. The detected radiation signals represent the radioactivity resulting from inelastic scattering and the measurement of neutron capture caused from the pulsing of the neutron source 26. The input terminal 30 in the illustrated portion of surface electronics 21 receives electrical pulses representative of the detected radiations. The pulses are coupled into a conventional sync and signal separator circuit 31. The sync or timing pulse is coupled out of sync and signal separator circuit 31 by conductor 32 to multichannel analyzer 33. The detector signals are coupled from sync and signal separator 31 by conductor 34 into multichannel analyzer 33. Multichannel analyzer 33 has seven outputs which are each connected into four address decoders, identified by numerals 35–38, respectively. The outputs of address decoders 35 and 36 are coupled into ratio circuit 39. The outputs of address decoders 37 and 38 are coupled into ratio circuit 40. The output of ratio circuits 39 and 40 are coupled into recorder 23.

The operation of the multichannel analyzer and the address decoders is explained in greater detail in U.S. Pat. No. 4,013,874, issued to R. B. Culver on Mar. 22, 1977. In accordance with the present application, address decoder 35 is configured to measure pulses in the 3.17 Mev to 4.65 Mev band of the capture gamma ray spectrum. Address decoder 36 is configured to measure pulses in the 4.86 Mev to 6.62 Mev band of the capture gamma ray spectrum. Address decoder 37 is configured to measure pulses in the 3.17 Mev to 4.65 Mev band of the inelastic gamma ray spectrum and address decoder 38 is configured to measure pulses in the 4.86 Mev to 6.62 Mev band of the inelastic gamma ray spectrum. The windows for address decoders 35–38 are graphically illustrated in FIG. 4 which shows a typical thermal neutron capture curve 41 following a neutron burst and a typical inelastic scattering curve 42.

In the operation of the portion of the surface circuitry shown in FIG. 3, it should be appreciated that address decoders 35–38 provide information, respectively, with regard to silicon, calcium, carbon and oxygen windows. Thus, ratio circuit 39 provides a silicon/calcium ratio and ratio circuit 40 provides a carbon/oxygen ratio, each of which is recorded on surface recorder 23.

Referring now to FIG. 4, there is illustrated graphically a plot of radioactivity counts versus energy showing both a capture spectrum and also an inelastic spectrum, in addition to the energy windows used for obtaining a Si/Ca ratio and a C/O ratio. As shown, the silicon capture window is coincident with the inelastic carbon window and the calcium capture window is coincident with the oxygen inelastic window.

Figure 5:
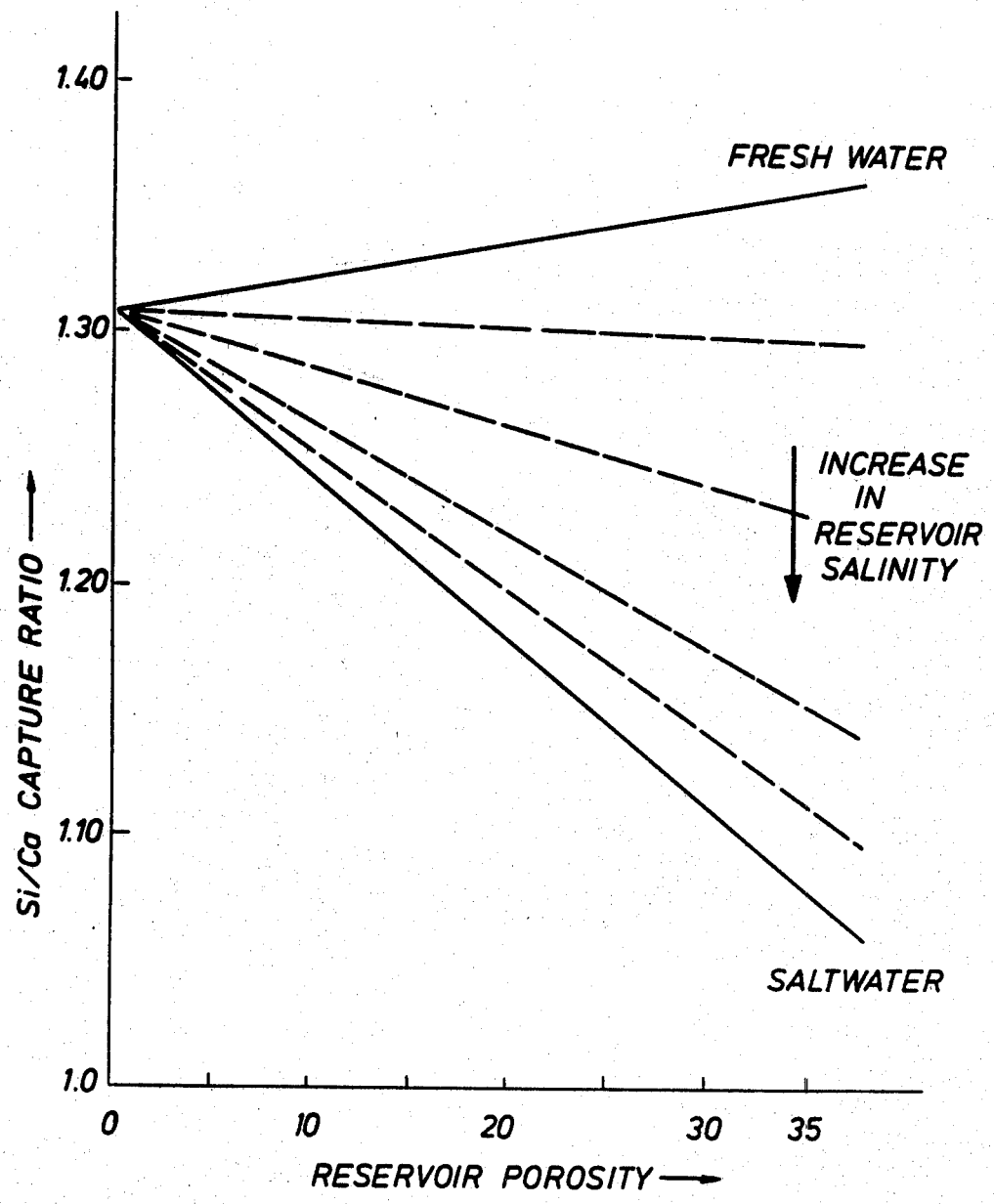
FIG. 5 graphically illustrates the salinity-sensitive nature of the silicon/capture ratio.

FIG. 5 graphically illustrates data which was derived using the windows illustrated with respect to FIG. 4. It has been found that using the described windows the silicon/calcium capture ratio is highly sensitive to water salinity. As shown in FIG. 5, with a known reservoir porosity the silicon/calcium ratio will vary in accordance with changes in reservoir salinity. In monitoring flood front movement in a water flood operation the monitoring wells are first logged to establish a base log of oil saturation, as represented by the carbon/oxygen ratio. Simultaneously, a base log of water salinity is established as indicated by the silicon/calcium ratio. The base logs should be run prior to commencement of water flooding.

As water is injected into the subsurface formation through injection wells 13*a* and 13*b* an area of increased oil saturation will preceed the water flood fronts 24 and 25. By logging the monitor wells in accordance with the description hereinbefore described the early progress of the flood front can be detected and monitored by repeating the logging operations in the prior logged monitor wells and comparing the later carbon/oxygen ratio logs with the base logs to determine increase in oil saturation.

Simultaneously with the carbon/oxygen ratio log there is obtained a silicon/calcium ratio log, as previously explained. By comparing the base silicon/calcium ratio logs with the later derived silicon/calcium ratio logs there is provided a method of monitoring salinity variations caused by the mixing of the known initial formation water salinity and the salinity of the injection water. By monitoring both oil saturation and the salinity mixing factor one can monitor the directional radial movement of the flood front within a permeable zone and detect any high-permeability streaks where the injected water moves faster than in the remainder of the permeable formation.

Thus, there has been described and illustrated herein a method for monitoring the movement of a flood front from within a cased borehole without the addition of elements to the injected water. However, obvious variations will occur to those skilled in the art. For example, rather than pulsing the neutron source a continuous source of neutrons can be employed, as from an isotopic americium-beryllium source. Further, injection water could be pumped into a central well to force oil radially to a series of outer production wells.

The embodiments of the invention in which an exclusive property or privilege is claimed are defined as follows:

1. A method for determining the profile of a fluid flood front traveling through earth formations located between a plurality of injection wells and a production well, comprising the steps of:

traversing a plurality of monitor boreholes located between said injection wells and said producing well with a source of high energy neutrons and a radiation detector;

irradiating the formations surrounding each of said plurality of monitor boreholes with high energy neutrons emitted from said source; detecting radiations emanating from said formations irradiated by said neutrons;

generating first electrical signals functionally related to the relative distribution of silicon to calcium contents of said formations, said first electrical signals indicative of salinity of the water within said formations;

generating second electrical signals functionally related to the relative distribution of carbon to oxygen contents of said formations, said second electrical signals indicative of oil saturation of said formations; and recording said first and second electrical signals for determining the arrival of said flood front at each of said plurality of monitor boreholes.

2. The method of claim 1, further comprising the steps of repeating said irradiating, detecting, generating and recording steps to establish a time-series profile of said flood front.

3. A method of monitoring fluid front movement through earth formations located between an injection well and a production well, comprising the steps of:

irradiating the formations surrounding a monitor borehole located intermediate said injection well and said production well;

detecting radiations emanating from said formations due to said irradiating;

generating first and second electrical signals functionally related to detected inelastic scattered radiations;

generating third and fourth electrical signals functionally related to detected capture radiations;

generating a fifth electrical signal functionally related to the ratio of said first and second electrical signals;

generating a sixth electrical signal functionally related to the ratio of said third and fourth electrical signals; and recording said fifth and said sixth electrical signals as indicators of fluid front movement.

4. The method of monitoring fluid front movement of claim 3, wherein said fifth electrical signal is functionally related to the oil saturation in said formations.

5. The method of monitoring fluid front movement of claim 4, wherein said first electrical signal is based upon detected radiation relating to carbon content of said formations and said second electrical signal is based upon detected radiation relating to oxygen content of said formations.

6. The method of monitoring fluid front movement of claim 5, wherein said first and second electrical signals are functionally related to inelastic scattered gamma radiations detected within the energy band ranges of 3.17 Mev to 4.65 Mev and 4.86 Mev to 6.62 Mev, respectively.

7. The method of monitoring fluid front movement of claim 3, wherein said sixth electrical signal is functionally related to the salinity of water in said formations.

8. The method of monitoring fluid front movement of claim 7, wherein said third electrical signal is based upon detected radiation relating to the silicon content of said formations and said fourth electrical signal is based upon detected radiation relating to the calcium content of said formations.

9. The method of monitoring fluid front movement of claim 8, wherein said third and fourth electrical signals are functionally related to capture gamma radiations detected within the energy band ranges of 3.17 Mev and to 4.65 Mev and 4.86 Mev to 6.62 Mev, respectively.

* * * * *